US005690603A

United States Patent [19]

Kain

[11] Patent Number: 5,690,603

[45] Date of Patent: Nov. 25, 1997

[54] EROGENIC STIMULATOR

[76] Inventor: Melissa Mia Kain, P.O. Box 737, Mulberry, Fla. 33860-0737

[21] Appl. No.: 589,191

[22] Filed: Jan. 22, 1996

Related U.S. Application Data

[63] Continuation-in-part of Ser. No. 44,464, Sep. 25, 1995, Ser. No. 44,405, Sep. 25, 1995, and Ser. No. 46,493, Nov. 16, 1995, Pat. No. Des. 376,650.

[51] Int. Cl.[6] ..... A61H 21/00

[52] U.S. Cl. ..... 600/38; 600/41

[58] Field of Search ..... 607/138; 600/38–41; 601/46; D24/200, 215, 214, 105

[56] References Cited

U.S. PATENT DOCUMENTS

| | | | |
|---|---|---|---|
| D. 320,087 | 9/1991 | Sholzberg et al. | D24/215 |
| 3,554,184 | 1/1971 | Habib | D24/105 |
| 3,996,930 | 12/1976 | Sekulich | 600/38 |
| 4,574,791 | 3/1986 | Mitchener | 600/38 |
| 5,127,396 | 7/1992 | McAllister | 600/38 |
| 5,387,179 | 2/1995 | Crivellaro | 600/38 |

FOREIGN PATENT DOCUMENTS

| | | | |
|---|---|---|---|
| WO94/07453 | 4/1994 | WIPO | 600/38 |

*Primary Examiner*—William E. Kamm
*Assistant Examiner*—George R. Evanisko
*Attorney, Agent, or Firm*—George A. Bode; Michael L. Hoelter; Bode & Associates

[57] ABSTRACT

A self-retaining erogenic simulator that provides simultaneous stimulation to both users thereof, whether they be of the same sex or of the opposite sex. This simulator is configured with a first phallic end which is used in the normal manner and a second bulbous end which is inserted within the vaginal or anal cavity of the wearing partner. This bulbous end is shaped with a neck-down region that enables this device to be held in place during use by the wearers' muscle groups without the need for straps or the like. Also, adjacent the base of the phallic end may be raised nubs which are designed for the clitoral stimulation of the wearing partner (when such partner is female) whether the device is inserted vaginally or anally. A hollowed-out area in the base can hold vibrating means for increased stimulation; or a fluid chamber within the apparatus allows the flow of fluid therein to increase stimulation.

15 Claims, 8 Drawing Sheets

FIG. 19
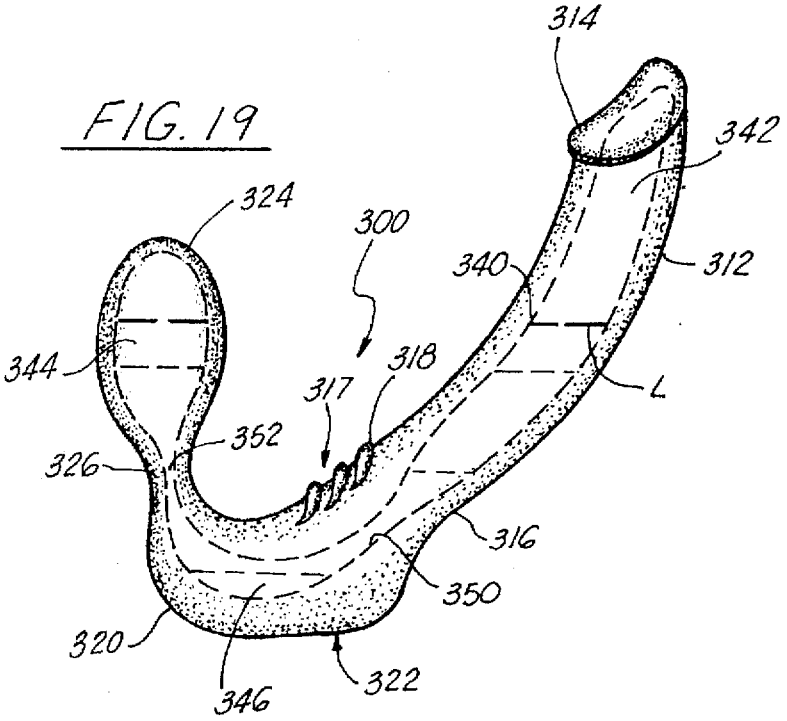
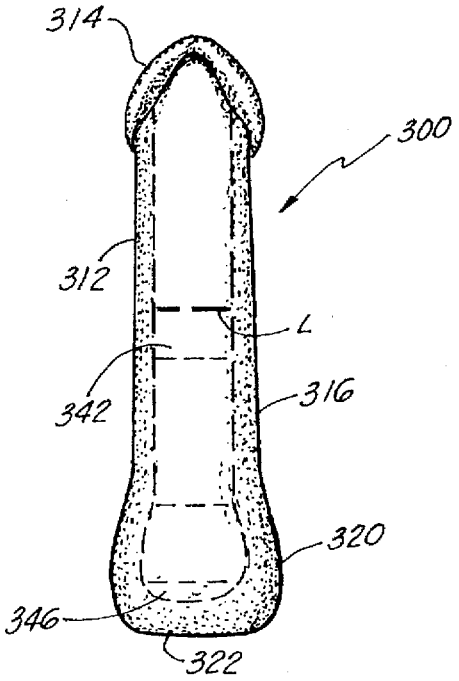
FIG. 20
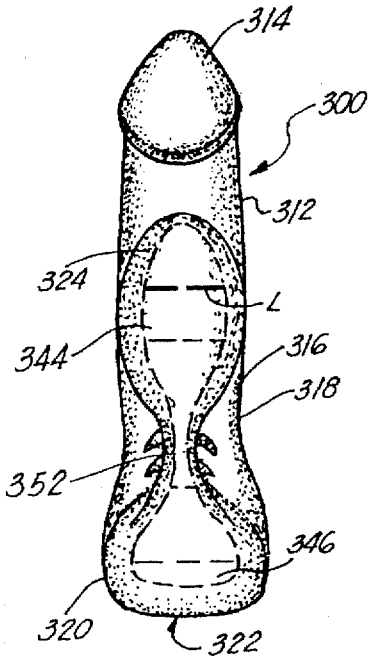
FIG. 21

EROGENIC STIMULATOR

This application is a continuation-in-part application of previous applications by the same inventor bearing U.S. Ser. No. 29/044,464 filed Sep. 25, 1995; No. 29/044,405 filed Sep. 25, 1995; and, No. 29/046,493 filed Nov. 16, 1995 now U.S. Design Pat. No. 0,376,650. The entire previous application Ser. Nos. 29/044,464; 29/044,405; and, No. 29/046,493 are incorporated herein by reference as if set forth in full below.

BACKGROUND OF THE INVENTION

1. Field of the Invention

This invention pertains to sexual or erogenous stimulation devices in general and, more particularly, to a self-retained device for simultaneous use by two sexual partners such that the erotic areas of both such users are concurrently excited.

2. General Background

Marital or sexual aids have been known and used throughout the centuries. Generally, such aids have been designed either for self-stimulation or for the stimulation of one party only. However, other such aids exist which attempt to satisfy a plurality of partners at the same time.

Of this latter type of aid, those designed primarily for use by the female have often incorporated a flexible phallic shape that is secured to a base. Variations include two such phallic shapes linearly secured to opposite sides of a common or intermediate flange. Unfortunately, because of the co-linear nature of these opposite shapes, the simultaneous use of such a device by two partners requires some rather gymnastic maneuvers.

Also, it is common for these devices to not be self-retaining. Instead, these devices rely upon a series of straps in order to hold and retain the device in place for proper use. However, fastening such straps prior to use is both cumbersome and discomforting and causes undesirable delay.

It is thus an object of the present invention to provide a marital or sexual aid that is capable of simultaneously stimulating the erotic areas of both such users.

It is a further object of this invention to provide such an aid that is self-retaining such that straps or other holding devices are not required thereby eliminating any delay and discomfort.

A further object of this invention is to provide a device that is capable of being used by partners of the same sex or of the opposite sex.

Still another object of this invention is to provide a device that is capable of flexing as needed but which returns to its original position upon its release.

Yet another object of this invention is to provide an aid that is designed with no abrupt flange or base to interfere with its use or its stimulating capabilities.

These and other objects and advantages of this invention will become evident upon further investigation.

SUMMARY OF THE PRESENT INVENTION

The preferred embodiment of the apparatus of the present invention solves the aforementioned problems in a unique, yet straightforward and simple manner. This invention pertains to an erogenic stimulator or, sexual or "marital" aid, that is configured having a first elongated, resilient and generally cylindrical end region that tapers downward to a reduced diameter region. This reduced diameter region permits the first end region to flex thereabout. Adjacent to this first end region is a second resilient and generally cylindrical end region that is configured with a neck-down region. This neck-down region enables the second end region to flex thereabout. Also, this second end region is smaller than the first end region with this second end region also being sized for insertion within the anal or vaginal cavity of the wearer. The neck-down region of this second end region permits the muscle groups of the wearer to hold this second end region in place during use. This invention also incorporates a means of flexibly connecting the first end region to the second end region in such a way that the wearing partner is stimulated. The receiving partner is stimulated in the customary way by the first end region. Alternate embodiments providing additional flexibility, vibrating means and dynamic fluid increase stimulation.

BRIEF DESCRIPTION OF THE DRAWING

For a further understanding of the nature and objects of the present invention, reference should be had to the following description taken in conjunction with the accompanying drawing in which like parts are given like reference numerals and, wherein:

FIG. 19 is a left side elevational view of the third alternate embodiment of the apparatus of the present invention;

FIG. 20 is a front elevational view of the embodiment of FIG. 19;

FIG. 21 is a rear elevational view of the embodiment of FIG. 19;

DETAILED DESCRIPTION OF THE PREFERRED EMBODIMENT

Figure 1:
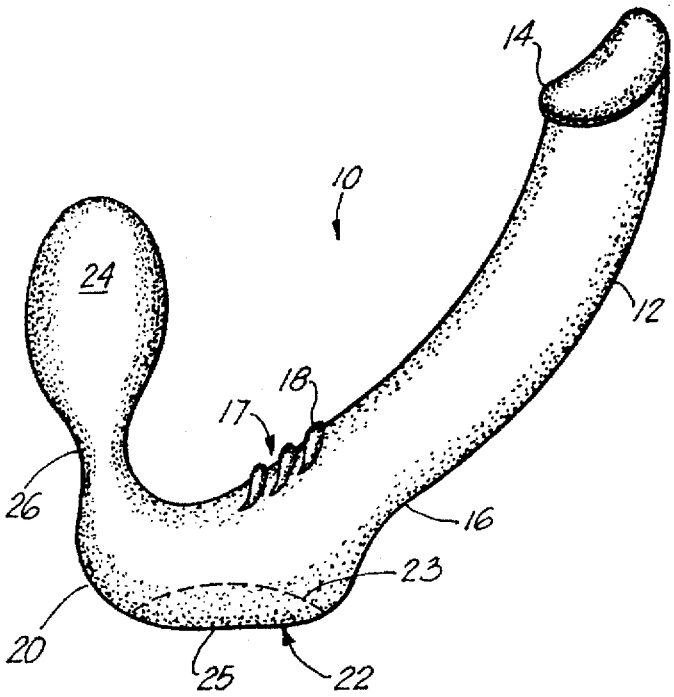
FIG. 1 is a left side elevational view of the preferred embodiment of the apparatus of the present invention.
Figure 2:
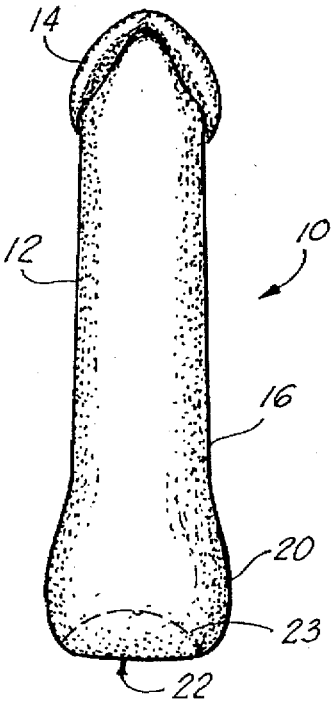
FIG. 2 is a front elevational view of the embodiment of FIG. 1.

Referring initially to FIGS. 1–5, there are shown different views of the preferred embodiment 10 of the erogenic stimulator or sexual aid of the present invention. Stimulator or aid 10 is designed for simultaneous use by two partners whether they are of the same sex or the opposite sex. Aid 10 is also specifically designed for use without the need for straps or the like. Instead, aid 10 is configured to be self-retaining as will be discussed hereinbelow.

As shown, aid 10 is generally curved concavely with one member or end thereof, end 12, being configured as a phallic emulator or "horse." This end 12 is of typical design being generally cylindrical in shape with an enlarged tip or head 14 as shown. The actual design of end 12 may vary, but preferably it will closely conform to that part of the enlarged male anatomy as is usual in the case.

End 12 is not only curved as shown, but it also gradually tapers from its distal to proximate portions to a reduced diameter region 16 which permits end 12 to flex thereabout in all directions during use. In fact, end 12 is designed to be rather resilient depending upon the comfort level desired and the forces acting upon it. However, end 12 is not so flaccid as to be incapable of retaining its cantilevered configuration, best seen in FIG. 1.

Reduced diameter region 16 is connected or coupled to common area or enlarged saddle 20 as best shown in FIGS. 1, 3, 4 and 5. This common area 20 (which is enlarged with respect to reduced diameter region 16) is generally integrally connected with phallic end 12 and constructed of the same material as is phallic end 12. However, enlarged area 20 may also be configured with its base 22 being hollow (phantom lines to show hollowed-out area 23) and with a cover or door 25 over such hollow base 22, so as to accept a battery powered vibrator (not shown) therein. This vibrator (not shown) could not only be inserted within base 22 of enlarged area 20 but even further towards phallic end 12 if hollowed-out area 23 were extended into region 16, such positioning and use thereby providing additional means of stimulation for both partners. Such vibrator may be removable or it may be a permanent part of aid 10.

Figure 9:
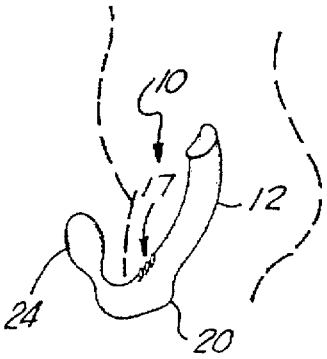
FIG. 9 is a side elevational view of a female having the preferred embodiment of FIGS. 1–5 in one position.
Figure 10:
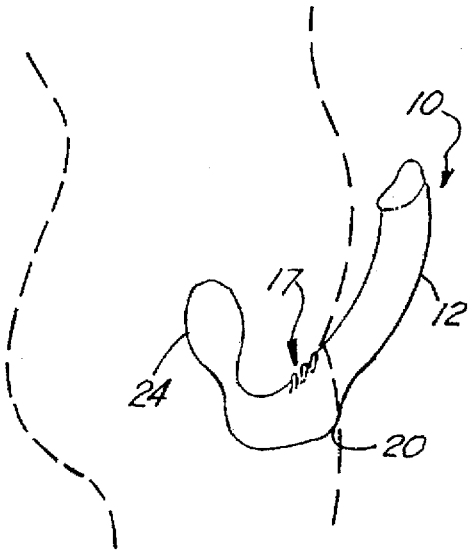
FIG. 10 is a side elevational view of a female having the preferred embodiment of FIGS. 1–5 in a second position.

Also connected to common area 20, at a side opposite that of phallic end 12, is rounded bulb or pony 24. Bulb 24 reduces greatly at its proximate or neck-down portion 26 where it integrally connects to saddle 20. Thus, aid 10 forms the concave shape of FIGS. 1–5. Bulb 24 provides a means of holding aid 10 in place during use, as best seen in FIGS. 9 and 10, such as by inserting bulb 24 inside either the vaginal or anal cavity of the dominant (wearing) partner. In either type of insertion, the neck-down portion 26 of bulb 24 provides a means for the vaginal or sphincter muscle groups to hold bulb 24 in place. Such neck-down portion 26 also provides for flexibility during use and it minimizes chafing of the tissues during application and use. Thus, by simply inserting bulb 24 within the dominant partner, aid 10 is retained in place by that partner's muscle groups.

Figure 3:
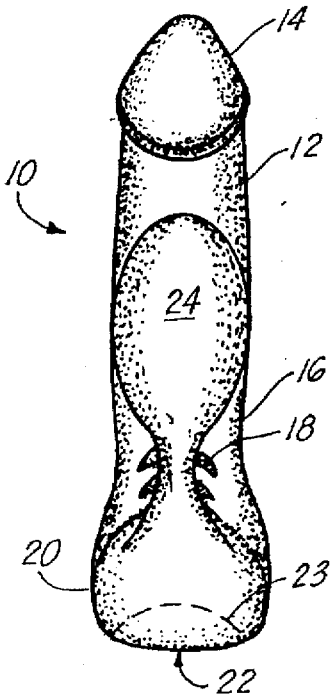
FIG. 3 is a rear elevational view of the embodiment of FIG. 1.
Figure 4:
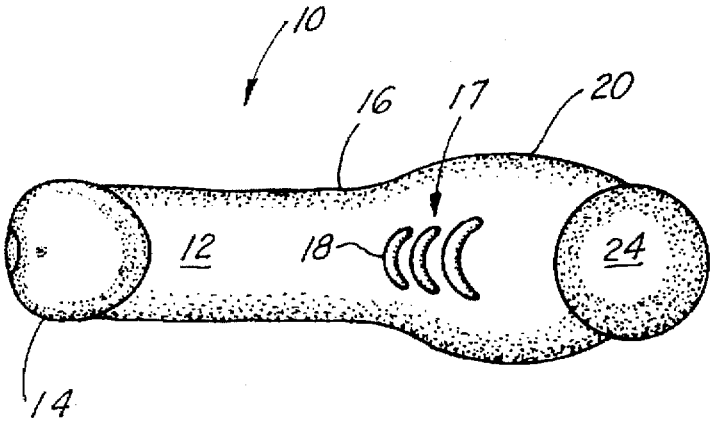
FIG. 4 is a top plan view of the embodiment of FIG. 1.
Figure 5:
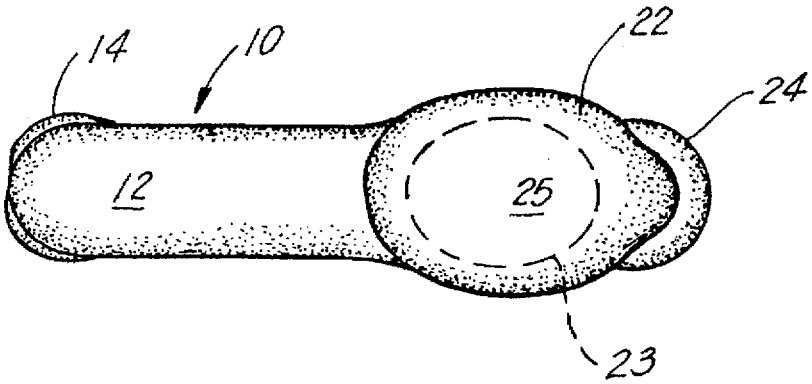
FIG. 5 is a bottom plan view of the embodiment of FIG. 1.

Beginning on the upper surface of reduced diameter region 16 and extending onto a portion of saddle 20 is a raised surface area 17 comprised of spaced-apart or intermittent raised nubs or chevrons 18. These nubs 18 can encircle saddle 20 if desired or they may only extend along one side, the upper side, thereof, as best seen in FIGS. 1, 3 and 4. Nubs 18 should not encircle reduced diameter region 16 or its function is defeated. These intermittent nubs 18 are primarily designed to provide additional clitoral stimulation to the dominant or wearing female partner during use, however, such nubs 18 will not impede or interfere with the use of aid 10 by a male. In fact, nubs 18 are located in such a manner that the dominant female partner will be stimulated whether aid 10 is inserted vaginally or rectally. Such stimulation is not available with common strap-on devices.

Consequently, phallic end 12 may be utilized to stimulate the other partner while raised nubs 18 simultaneously stimulate the wearing partner should such wearing partner be female. However, should the wearing partner be male, raised nubs 18 will not interfere with such use.

One unique feature of aid 10 is its ability to be configured so as to offer a variety of different degrees of rigidity by simply varying the diameter of reduced region 16 and/or neck-down region 26. Also, by the independent coupling of reduced diameter region 16 and neck-down region 26 to common area 20, phallic end 12 and bulb 24 may now be separately and independently flexed. Furthermore, the elimination of the need for any type of strapping device greatly enhances the use of aid 10 by eliminating any delay or discomfort normally associated with such straps. Additionally, aid 10 also provides the dominant (wearing) partner with stimulation simultaneous with that of the other partner for greater enjoyment and satisfaction.

Aid 10 may be constructed of a rather rigid material such as hard plastic, rubber, or the like. However, it is preferable for aid 10 to be constructed of a more compressible or resilient material, such as soft plastic or a foam material, of the type that is capable of retaining its shape and rigidity during use, but which is not so un-bending or inflexible as to be uncomfortable. Also, an outer continuous covering or coating which is both smooth and slippery over such material would further enhance the enjoyment of aid 10. Finally, it is anticipated that the angle between phallic end 12 and bulb 24 would be in the range of from 60 to 80 degrees, more or less, so as to provide the most comfort during use, however, such angle may be as sharp as 45 degrees or as great as 90 degrees in some instances.

Of course, the actual length and diameter of phallic end 12 and bulb 24 can vary as needed depending on the needs of the partners. In this fashion, it is anticipated that different sizes of these ends 12 and 24 can be offered which correspond with different diameters of reduced region 16 and neck-down region 26 so that aid 12 can conform to the needs and comfort levels of the intended users. Furthermore, in the configuration shown in FIGS. 1–5, common area 20 is illustrated having a cross-section greater than that of either end 12 or bulb 24, however, if desired, the cross-sectional area of common area 20 may be equal to or even less than that of either end 12 or bulb 24. In the preferred embodiment 10 of FIGS. 1–5, enlarged saddle 20 may be gripped between the uppermost thigh area by the wearing or driving partner (FIG. 10) affording additional control of end 12 for more athletic engagements, or as reinforcement of vaginal retention of bulb 24, particularly if vaginal musculature is severely impaired.

Figure 6:
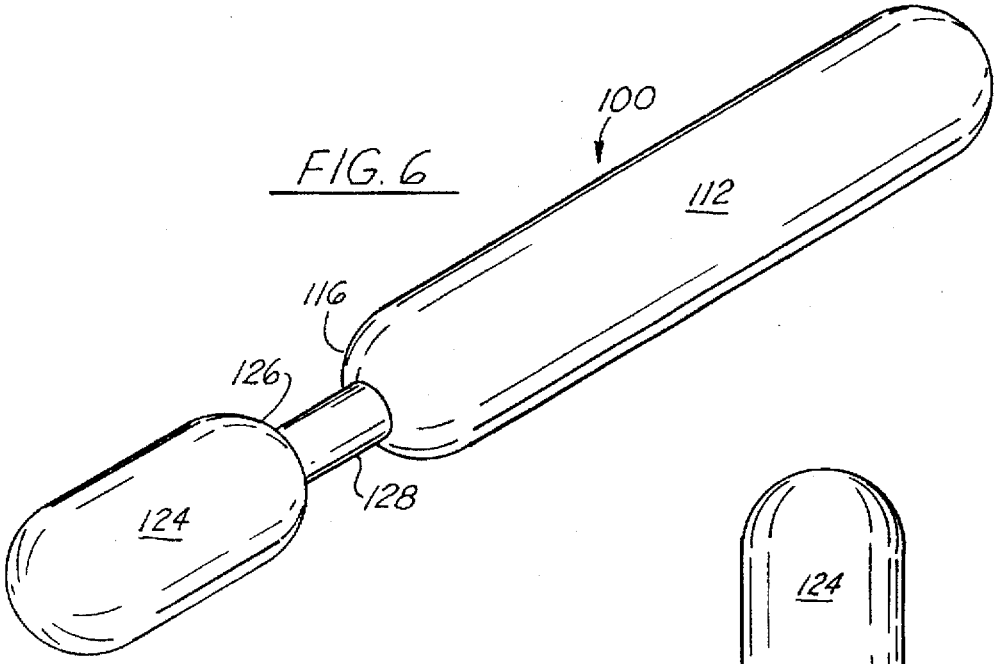
FIG. 6 is a top, front and right side perspective view of the first alternate embodiment of the apparatus of the present invention.
Figure 7:
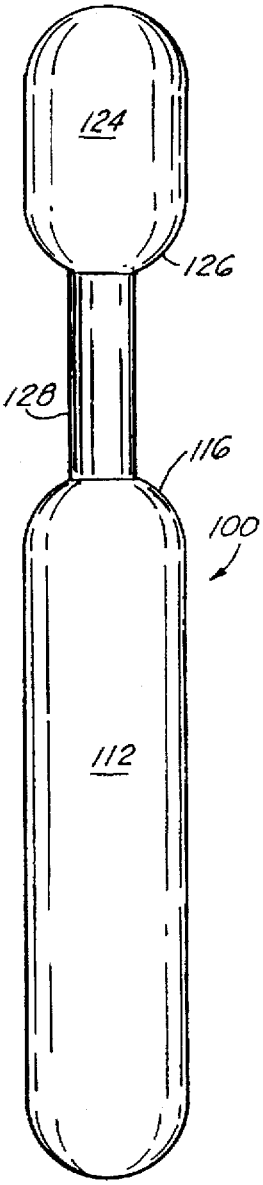
FIG. 7 is a right side elevational view of the embodiment of FIG. 6, the left side being a mirror image of that shown.
Figure 8:
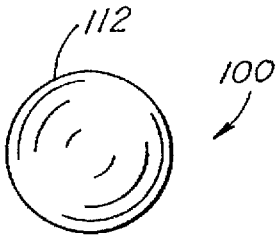
FIG. 8 is a front elevational view of the embodiment of FIG. 6, the rear elevation being a mirror image of that shown.

FIGS. 6–8 illustrate a first alternate embodiment of the apparatus of the present invention—stimulator or aid 100. In this embodiment, aid 100 is generally linear as shown, but it is quite capable of flexing to an angle of from about 60 to 80 degrees during use as is the more elaborately shaped aid 10 discussed above. According to this embodiment, end 112 is more cylindrical in shape and configuration and does not take on the phallic shape of aid 10 as discussed above. However, it functions in the same manner in that it still provides the same (or nearly the same) pleasure as is enjoyed by the use of above phallic end 12 and saddle area 20. Similarly, bulb 124 is also more cylindrical in nature than the more rounded bulb 24 described above. Connecting the two together (integrally) is bridge 128 which is quite flexible and functions the same as neck-down region 26 of aid 10 described with respect to the embodiment 10 of FIGS. 1–5. To permit such flexibility between ends 112, 124, the cross-sectional area at shoulders 116, 126 of ends 112, 124, respectively, is slightly less than the cross-sectional area of either of ends 112, 124. Also, while not shown in this embodiment, a raised surface area such as area 17 of aid 10 having nubs 18 can also be placed along or around the shoulders 116, 126 if so desired to further enhance the pleasure of the dominant (driving/wearing) female partner (bridge 128 is a cylindrical embodiment of saddle 20).

Figure 11:
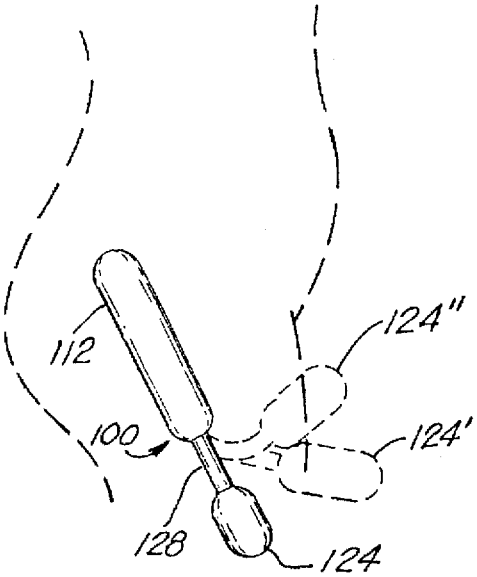
FIG. 11 is a side elevational view of a female having the first alternate embodiment of FIGS. 6–8 in one position.
Figure 12:
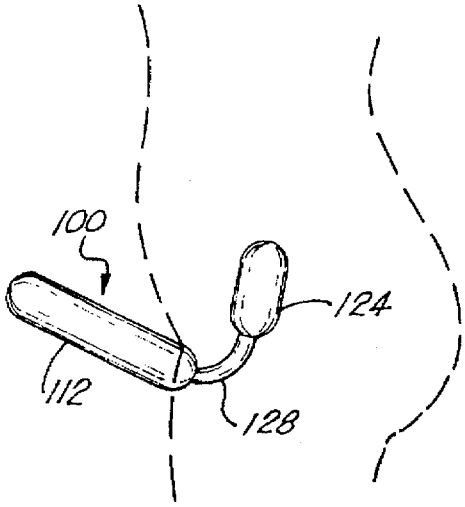
FIG. 12 is a side elevational view of a female having the first alternate embodiment of FIGS. 6–8 in a second position.

As best seen in FIGS. 11 and 12, alternate embodiment 100 functions roughly in the same manner as that described above for preferred embodiment 10, although its appearance is less contoured and more linear. Due to diameter reductions at 116 and 126, area 128 takes the place of saddle area 20 of preferred embodiment 10. During use, shorter end or bulb 124 would be inserted within the vaginal or anal cavity of the wearing partner and would be held in place there by the wearer's muscle groups closing around bridge 128. Opposite end 112 would then be used to provide pleasure to each partner. End 112 and end 124 would be somewhat rigid during use so as not to be flaccid with the needed flexibility or resiliency between the two being provided by bridge 128. The material of construction and the outer covering may also be the same as described above.

Figure 13:
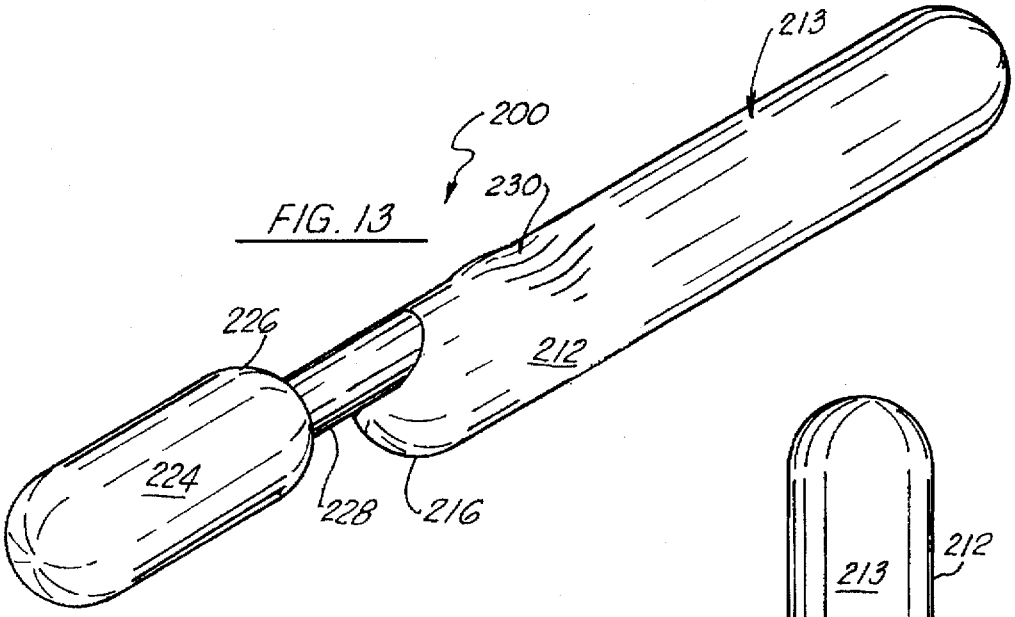
FIG. 13 is a top, rear and right side perspective view of the second alternate embodiment of the apparatus of the present invention.
Figure 15:
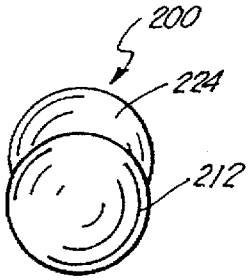
FIG. 15 is a front elevational view of the embodiment of FIG. 13.
Figure 16:
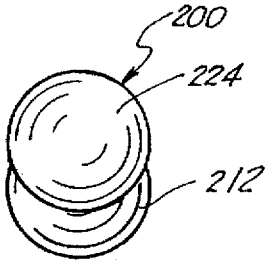
FIG. 16 is a rear elevational view of the embodiment of FIG. 13.
Figure 14:
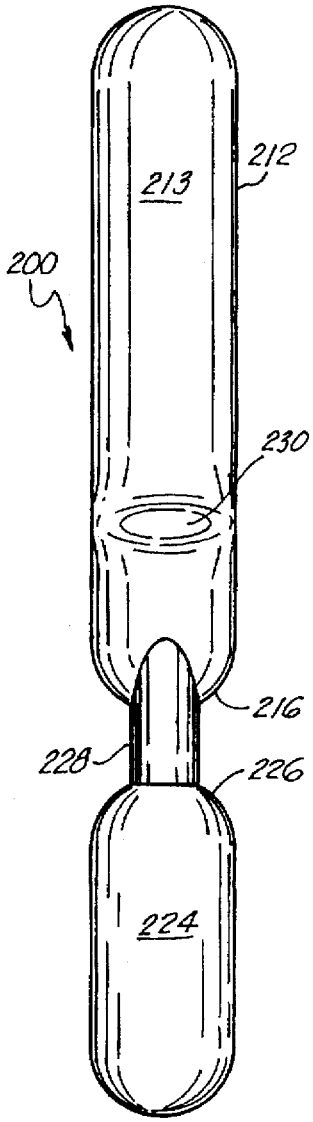
FIG. 14 is a top plan view of the embodiment of FIG. 13.
Figure 17:
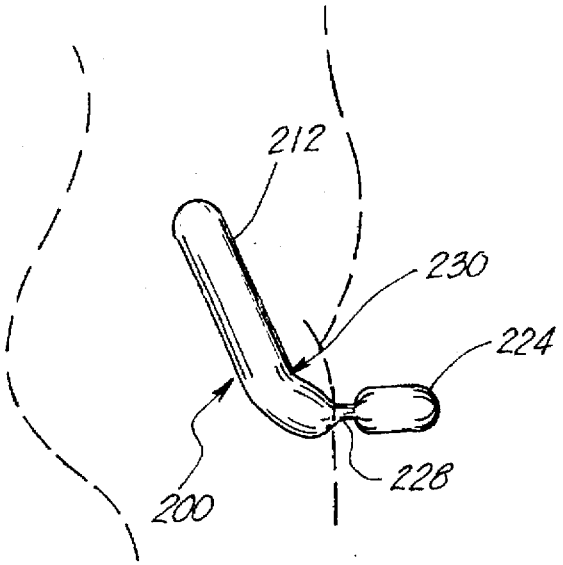
FIG. 17 is a side elevational view of a female having the second alternate embodiment of FIGS. 13–16 in one position.
Figure 18:
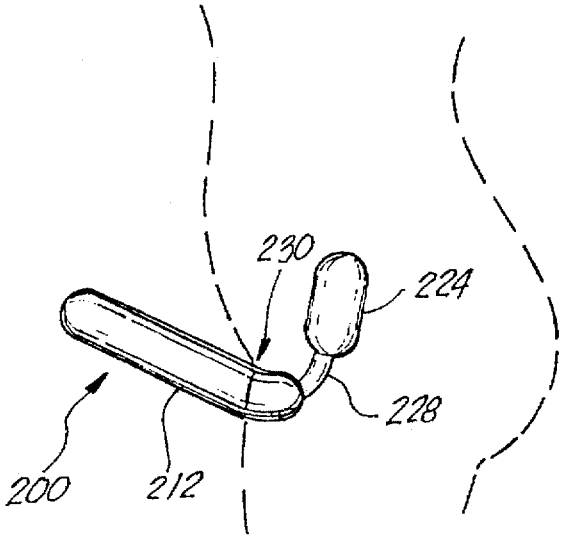
FIG. 18 is a side elevational view of a female having the second alternate embodiment of FIGS. 13–16 in a second position.
Figure 22:
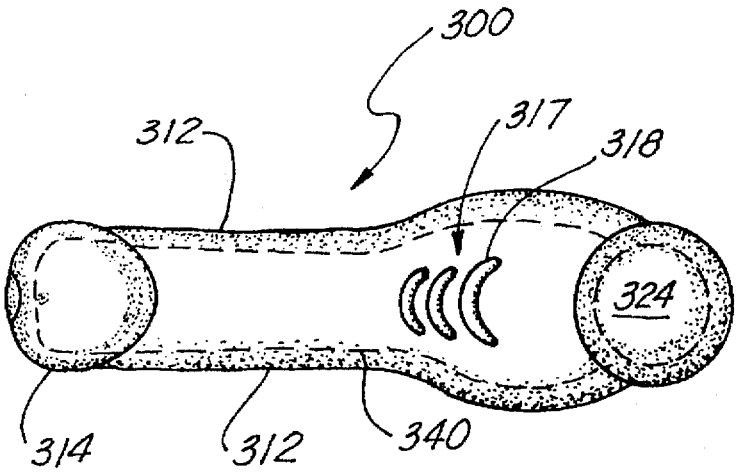
FIG. 22 is a top plan view of the embodiment of FIG. 19.
Figure 23:
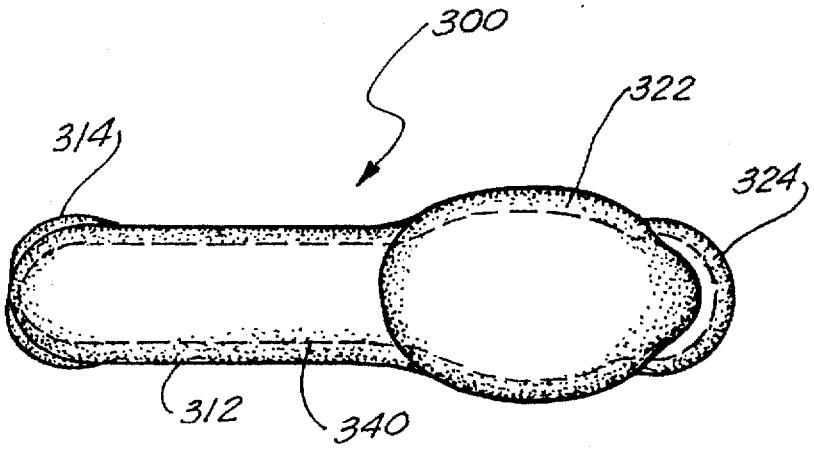
FIG. 23 is a bottom plan view of the embodiment of FIG. 19.

FIGS. 13–16 illustrate a second alternate embodiment of the present invention, stimulator or aid 200. In this embodiment, aid 200 is generally linear as is aid 100 as shown, but is capable of flexing to an angle of from about 60–80 degrees during use as are aid 10 and aid 100 discussed above. According to this embodiment, end 212 and end 224 are both cylindrical in shape and connected by bridge 228, however, end 212 is off-set laterally from end 224 in the manner shown in FIGS. 13, 15 and 16. Further, there is provided a transverse notch or depression 230 in the top portion 213 of end 212 near its connection to bridge 228. The laterally off-set arrangement of ends 212, 224, causes bridge 228 to connect (preferably integrally) to the proximate end of end 212 at the top portion 213 thereof and to the proximate end of end 224 at the center thereof, all as best seen in FIGS. 13 and 14. As with embodiment 100, embodiment 200 is provided with neck-down or shoulder regions 216, 226 on ends 212, 224, respectively, to permit flexibility between the ends. In use, transverse notch 230 allows end 212 to bend to an enhanced degree (as compared to aid 100), particularly at an important point of stimulation as is illustrated in FIGS. 17 and 18. As seen in FIGS. 17 and 18, embodiment 200 functions similar to that described for first alternate embodiment 100. During use, shorter end or bulb 224 would be inserted within the vaginal or anal cavity of the dominant wearing partner and would be held in place there by the wearer's muscle group closing around bridge 228. Opposite end 212 would then be used to provide pleasure to each partner. End 212 and end 224 would be somewhat rigid during use, however, end 212 will have some flexibility as it will bend due to notch or depression 230, FIG. 17 showing greater bending than in FIG. 18.

Referring now to FIGS. 19–23, there is shown a third alternate embodiment 300 of the apparatus of the present invention. Embodiment 300 is similar to preferred embodiment 10 in that it is concavely curved, with one end thereof, end 312, being configured as a phallic emulator being generally cylindrical in shape with an enlarged head 314 and the other end 324 being a bulb with neck-down area 326, reduced areas 316, 326 being connected (integrally) to opposing sides of saddle 320. On the upper surface of saddle 320 and reduced diameter region 316 of end 312 is raised surface 317 having spaced-apart or intermittent hubs 318 which can encircle region 320, if desired. The additional element that the third alternate embodiment 300 adds to the preferred embodiment 10 is a fluid chamber 340 having a portion 342 in end 312, a portion 346 in saddle 320 and a portion 344 in bulb 324; portions 342, 346, 344 being in fluid communication. Chamber 340 has reduced areas 350, 352 between areas 340, 346 and 344, 346, respectively, for purposes to be described further herein. Within chamber 340 is provided a fluid which, when aid 300 is in the static position of FIG. 19, assumes a level "L". As can be seen from FIGS. 19–23, the amount of fluid is such that at the level "L" portions of chambers 340 and 344 remain unfilled so that upon movement of apparatus 300 during use, the fluid will be able to move in the various portions thereof. In use, as bulb 324 is inserted within the dominant partner and end 312 inserted within the other partner, fluid in chamber 340 will be forced from area 344 to area 342 or vice-versa depending upon the muscular activity of the partners. It can, therefore, be understood that if chamber portion 344 and 346 are substantially filled with fluid so that the fluid level in chamber portion 342 is substantially below the level "L" exertion on the part of the wearing or dominant partner will force fluid from chamber portions 344, 346 into chamber portion 342 through the reduced area 350 causing an increase in velocity of the fluid and, therefore, increased stimulation to the accepting partner.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An erogenic stimulator for use by two partners comprising:

(a) a first elongated, resilient and generally cylindrical end region tapering to a reduced diameter portion, said reduced diameter portion enabling said first end region to flex thereabout;

(b) a second resilient and generally cylindrical end region sized for receipt in an anal or vaginal cavity having a neck-down portion, said neck-down portion enabling said second end region to flex thereabout, said second end region being shorter than said first end region, said neck-down portion adapted for permitting the muscle groups of one of said partners to hold said second end region in place during use; and, (c) means for flexibly connecting said first end region to said second end region, said connecting means comprising a common saddle area larger in cross-section than the cross-section of either said first or second end regions, said first and second end regions being connected to opposing sides of said common saddle area, said reduced diameter portion of said first end region being connected to a first or one of said opposing sides of said common saddle area and wherein said neck-down portion of said second end region is connected to a second or the other of said opposing sides of said common saddle area, whereby said first and second end regions are separately and independently flexible about, respectively, said reduced diameter portion and said neck-down portion.

2. The apparatus set forth in claim 1, wherein a portion of said common saddle area is hollow with access provided thereto via a third side of said common saddle area.

3. The apparatus as set forth in claim 1, wherein said first and second sides of said common saddle area are offset or displaced from each other at an angle of about 60 to about 80 degrees.

4. The apparatus aid as set forth in claim 1, wherein said second end region is bulbous in shape adapted for insertion and retention within the anal or vaginal cavity of the wearer.

5. The apparatus as set forth in claim 1, wherein said first end region is curved and phallic shaped with an enlarged tip.

6. The apparatus as set forth in claim 1, further comprising a raised surface area on said connecting means for stimulation of the clitoral region of a wearing female partner.

7. An erogenic stimulator for use by two partners comprising:

(a) a first elongated, resilient and generally cylindrical end region having proximate and distal end portions and tapering to a reduced diameter portion at said proximate end portion thereof, said reduced diameter portion enabling said first end region to flex thereabout;

(b) a second resilient and generally cylindrical end region sized for receipt in an anal or vaginal cavity having proximate and distal end portions and a neck-down portion at said second end region proximate end portion thereof, said neck-down portion enabling said second end region to flex thereabout, said second end region being shorter than said first end region, said neck-down portion adapted for permitting the muscle groups of one of said partners to hold said second end region in place during use; and, (c) means for flexibly connecting said reduced diameter portion of said first end region to said neck-down portion of said second end region, said connecting means comprising a common saddle area larger in cross-section than the cross-section of either said first or second end regions, said first and second end regions being connected to opposing sides of said common saddle area, said reduced diameter portion of said first end region being connected to a first or one of said opposing sides of said common saddle area and wherein said neck-down portion of said second end region is connected to a second or the other of said opposing sides of said common saddle area, whereby said first and second end regions are separately and independently flexible about, respectively, said reduced diameter portion and said neck-down portion.

8. The apparatus as set forth in claim 7, wherein said first and second end regions are connected to opposing sides of said connecting means and depending generally upwardly therefrom, whereby said stimulator takes a generally concave shape.

9. The apparatus as set forth in claim 7, wherein said first end region has a transverse depression in one side thereof, said depression positioned near said connection to said connecting means.

10. The apparatus as set forth in claim 7, wherein said first and second sides of said connecting means are offset or displaced from each other at an angle of about 60 to 80 degrees.

11. The apparatus aid as set forth in claim 7, wherein said second end region is bulbous in shape adapted for insertion and retention within the anal or vaginal cavity of the wearer.

12. The apparatus as set forth in claim 7, wherein said first end region is curved and phallic shaped with an enlarged tip.

13. The apparatus as set forth in claim 7, further comprising a raised surface area on said connecting means for stimulation of the clitoral region of a wearing female partner.

14. An erogenic stimulator for use by two partners comprising:

(a) a first elongated, resilient and generally cylindrical member having distal and proximate end portions and tapering from said distal to said proximate end portions to a reduced diameter portion, said reduced diameter region enabling said first member to flex thereabout;

(b) a second resilient and generally cylindrical member sized for receipt in an anal or vaginal cavity having proximate and distal end portions and a neck-down area at said second member proximate end portion, said neck-down area enabling said second member to flex thereabout, said second member being shorter than said first member, said neck-down area adapted for permitting the muscle groups of one of said partners to hold said second member in place during use;

(c) means for flexibly connecting said proximate end portion of said first member to said proximate end portion of said second member; and, (d) fluid chamber extending within said first and second members and said connecting means, whereby when a fluid is provided in said chamber, it is permitted to communicate between said first and second members through said connecting means.

15. The apparatus as set forth in claim 14, further comprising a raised surface area on one surface of said connecting means for stimulation of the clitoral region of a wearing female partner.

* * * * *